US005775749A

United States Patent [19]

Reithmeyer et al.

[11] Patent Number: 5,775,749

[45] Date of Patent: Jul. 7, 1998

[54] LATCH KEEPER ASSEMBLY

[75] Inventors: Joseph Guy Reithmeyer, Afton, Minn.; Stephen M. Purcell, Loves Park, Ill.; Dean A. Pettit, Rockford, Ill.

[73] Assignee: Andersen Corporation, Bayport, Minn.

[21] Appl. No.: 695,145

[22] Filed: Aug. 8, 1996

[51] Int. Cl.[6] ..... E05B 15/02

[52] U.S. Cl. ..... 292/341.18; 292/DIG. 46

[58] Field of Search ..... 292/340, DIG. 46, 292/341.18, 341.15, DIG. 60, DIG. 55

[56] References Cited

U.S. PATENT DOCUMENTS

| | | | |
|---|---|---|---|
| 839,556 | 12/1906 | Cuff | 292/341.18 |
| 1,111,425 | 9/1914 | Ziganek et al. . | |
| 1,463,384 | 7/1923 | Butterworth . | |
| 1,596,242 | 8/1926 | Dunn . | |
| 2,710,217 | 6/1955 | Gurtiss, Jr. et al. . | |
| 2,844,020 | 7/1958 | Chittum et al. | 292/DIG. 46 |
| 3,026,702 | 3/1962 | Cary . | |
| 3,040,555 | 6/1962 | Wartian | 292/DIG. 46 |
| 3,173,716 | 3/1965 | Silvers | 292/DIG. 46 |
| 3,618,804 | 11/1971 | Krause | 292/341.18 |
| 4,563,885 | 1/1986 | Madden . | |
| 4,891,921 | 1/1990 | Governale . | |
| 4,915,428 | 4/1990 | Hayakawa . | |
| 5,174,617 | 12/1992 | Huber et al. | 292/DIG. 46 |
| 5,595,409 | 1/1997 | Fier et al. | 292/341.18 |

FOREIGN PATENT DOCUMENTS

| | | | |
|---|---|---|---|
| 2459864 | 2/1981 | France | 292/DIG. 46 |
| 2701056 | 8/1994 | France | 292/DIG. 46 |

*Primary Examiner*—Rodney M. Lindsey

*Attorney, Agent, or Firm*—Merchant, Gould Smith Edell Welter & Schmidt

[57] ABSTRACT

A latch keeper is mounted to a keeper housing in such a manner that a first portion of the latch keeper engages a latch hook on one side of a housing wall, and a second portion of the latch keeper is disposed on an opposite side of the housing wall. When the latch hook and the latch keeper are interengaged and a force is applied, the latch keeper imparts a moment force against the keeper housing.

22 Claims, 5 Drawing Sheets

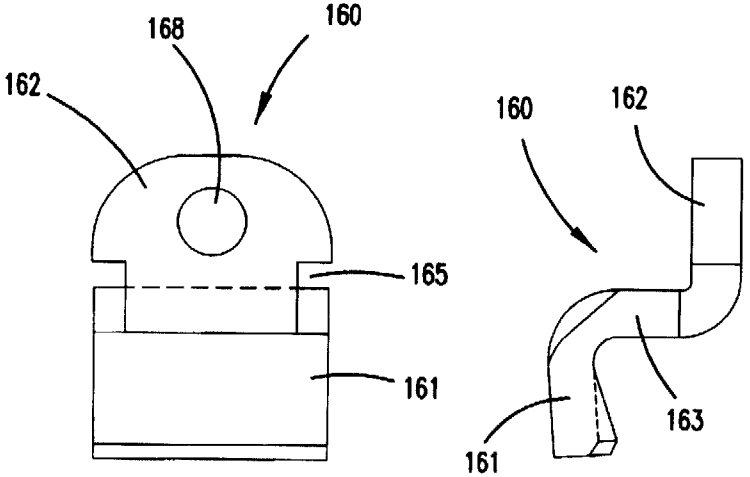
FIG. 11
FIG. 12
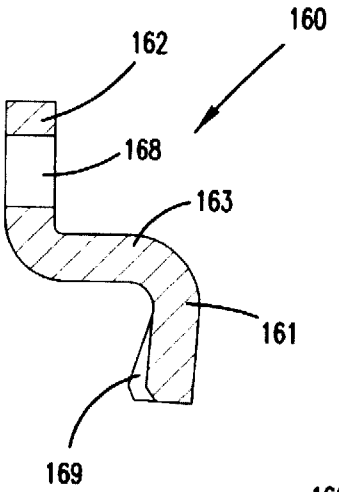
FIG. 13
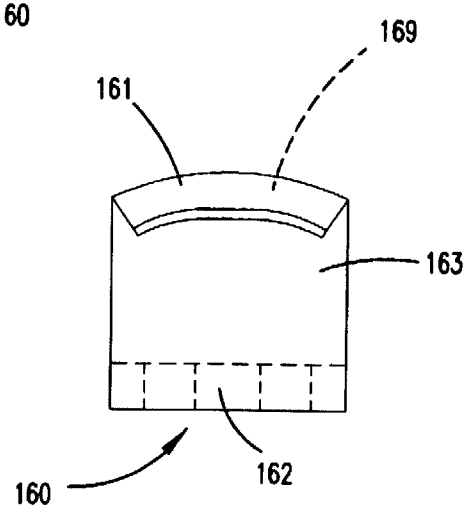
FIG. 14

LATCH KEEPER ASSEMBLY

FIELD OF THE INVENTION

The present invention relates to latches or locks and in particular, to an improved assembly for latching or locking gliding doors and the like.

BACKGROUND OF THE INVENTION

Crime is a significant problem in the United States today, and public awareness of crime continues to rise. A natural reaction, which is evident in the marketplace, is that people are seeking additional security against crime, not only as a preventive measure but also simply for greater peace of mind. Accordingly, the degree of security associated with a given product is, now more than ever, a significant factor in the minds of the purchasing public. Obviously, the security factor is particularly acute in relation to the home.

People want to be safe and feel secure in their homes. However, the typical person does not want his or her home to look or feel like a fortress. A balance must be struck between safety and comfort. Convenience and cost must be taken into account, as well. The gliding glass door is a relatively popular home feature that exemplifies the kind of compromise between comfort and safety that people are willing to accept. The large expanse of glass "opens up" a room by allowing sunlight to enter and allowing occupants of the room to look outside, but the large expanse of glass also provides access to any criminal who would be willing to break the glass to enter through the door. In this regard, however, criminals typically prefer less conspicuous modes of entry, such as through an unlocked or easily "jimmied" door. Thus, most people would be comfortable with the security afforded by a gliding glass door so long as the door can be reliably and securely locked, and breaking the glass is the only way to gain unlawful entry.

SUMMARY OF THE INVENTION

The present invention provides a latch keeper that is cost effective to manufacture and reliable in use. The present invention is shown and described with reference to a preferred embodiment intended for use in connection with a gliding door unit of a type having at least one door that glides within a door frame. In this preferred embodiment, a latch hook engages a concave bearing surface on the latch keeper. The bearing surface cooperates with any force applied to the latch assembly to bias the latch hook toward a centered position. Resistance to any such force is provided in the form of a turning movement transmitted directly through the housing. These advantages and others will become apparent upon a more detailed description of the invention.

BRIEF DESCRIPTION OF THE DRAWING

With reference to the Figures of the drawing, wherein like numerals represent like parts and assemblies throughout the several views.

FIG. 11 is a rear view of a latch keeper that is part of the preferred embodiment latch keeper assembly shown in FIG. 1;

FIG. 12 is a side view of the latch keeper shown in FIG. 11;

FIG. 13 is a sectioned, opposite side view of the latch keeper shown in FIG. 11; and FIG. 14 is a bottom view of the latch keeper shown in FIG. 11.

DETAILED DESCRIPTION OF A PREFERRED EMBODIMENT

Figure 1:
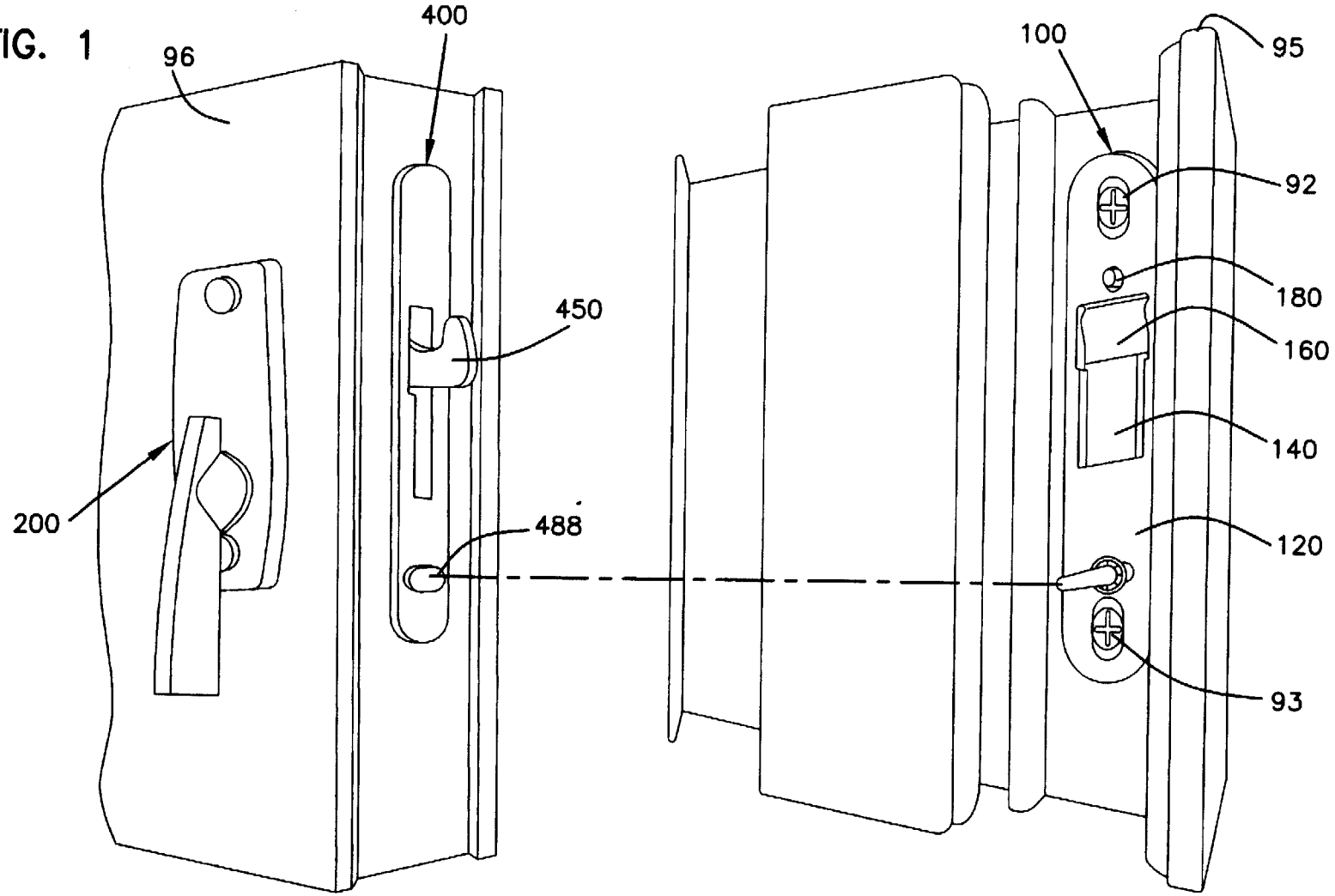
FIG. 1 is a perspective view of a gliding door latch assembly including a preferred embodiment latch keeper assembly constructed according to principles of the present invention.
Figure 2:
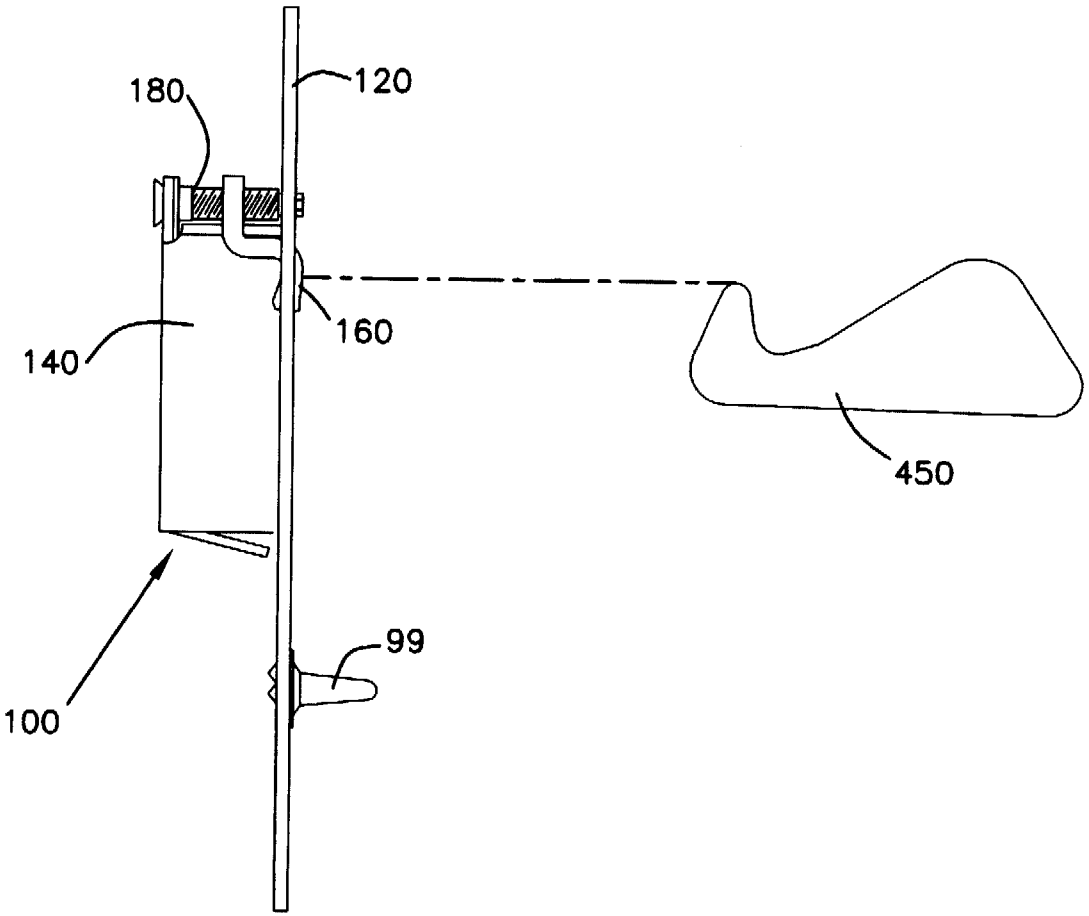
FIG. 2 is a side view of the latch and the preferred embodiment latch keeper assembly shown in FIG. 1.

A lock or latch assembly constructed according to the principles of the present invention is shown in FIG. 1.

The latch assembly may be installed on a gliding door unit as shown and described in U.S. patent application Ser. No. 08/270,496, entitled "Gliding Door Latch Assembly" and filed on Jul. 5, 1994. The '496 application and the present invention are owned by a common assignee, and the former is incorporated herein by reference. Those skilled in the art will recognize that the latch assembly of the present invention may be used to selectively latch a leading member on a door 96 relative to a vertical jamb on a door frame 95 to prevent gliding or movement of the door relative to the frame (i.e. to lock the door).

The latch assembly of the present invention generally includes a latch portion 400, and a keeper portion 100, including parts 120, 140, 160, 180, and 198. The latch portion 400 is shown and described in detail in the '496 application and is not the focus of the present invention. The latch portion 400 is mounted to the leading member on a first door 96, and the keeper portion 100 is mounted to the vertical jamb on frame 95. The latch portion 400 cooperates with the keeper portion loo to selectively latch the first door 96 relative to the frame 95.

As explained in the '496 application, a manual operator 200 is secured to an inwardly facing side of the leading member and is operatively connected to the latch portion 400 in such a manner that operation of the manual operator 200 is linked to latching and unlatching of the latch portion 400 relative to the keeper portion 100. Additionally, a key operator (not shown) is secured to an outwardly facing side of the leading member and is operatively connected to the latch portion 400 and to the manual operator 200 in such a manner that operation of the key operator is linked to latching and unlatching of the latch portion 400 relative to the keeper portion 100, and is also linked to operation of the manual operator 200.

Although the latch portion disclosed in the '496 application is discussed herein as part of the preferred embodiment, those skilled in the art will recognize that the keeper portion 100 may be used with other latch portions as well, and that the present invention is not necessarily limited to the latch portion disclosed in the '496 application.

Figure 6:
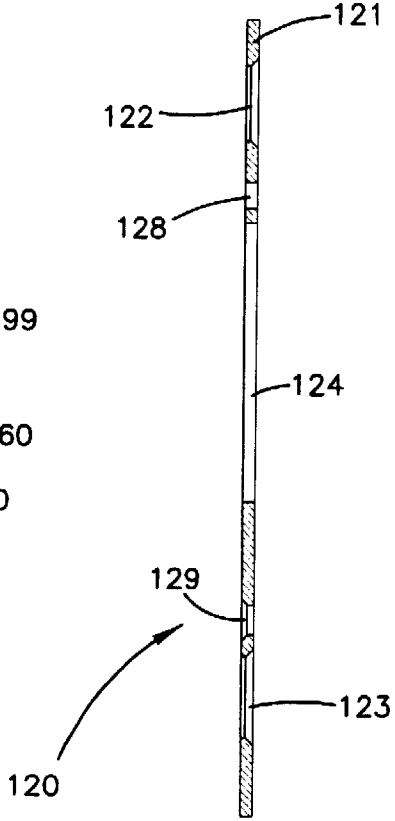
FIG. 6 is a sectioned side view of a strike plate that is a part of the preferred embodiment latch keeper assembly shown in FIG. 1.

As mentioned above, the keeper portion 100 includes a strike plate 120 which is described with reference to FIGS. 3 and 6. The strike plate 120 is a relatively elongate metal strip 121 and is intended to be secured flush against the surface of the vertical jamb, facing toward the leading member on the door. A pair of slots 122 and 123 are formed through the strip 121 to facilitate mounting of the strike plate 120 to the jamb by means of screws 92 and 93. The slots 122 and 123 are made elongate to allow vertical adjustment of the keeper portion 100 relative to the latch portion 400 without requiring that additional holes be drilled into the vertical jamb. In this manner, interengaging parts on the latch portion 400 and the keeper portion 100 may be conveniently aligned relative to one another.

A relatively large rectangular opening 124 is formed through the strip 121 proximate its geometric center to receive at least a portion of the latch 450. An elliptical hole 128 is formed through the strip 121 between the slot 122 and the opening 124 for reasons discussed below. Also, a laterally extending, elongate slot 129 is formed through the strip 121 to receive and retain a spike 99, which extends toward the face plate of the latch assembly 400 and deflects a button 488 as the leading member approaches the vertical jamb (when the keeper portion 100 is used together with the latch portion 400). The spike 99 may be adjustable laterally within the slot 129 to facilitate alignment of the spike 99 and the button 488 prior to tightening of the screws 92 and 93 that secure the strike plate 120 to the vertical jamb. When the spike 99 is satisfactorily aligned with the button 488, the screws 92 and 93 are tightened, and nubs or cleats on the head of the spike 99 dig into the jamb to secure the spike 99 against further lateral movement.

The keeper portion 100 further includes a keeper housing 140 which is described with reference to FIGS. 710. The housing 140 is sized and configured to be nested within the vertical jamb. The housing 140 is generally box-shaped with an open side opening toward and aligned with the opening 124 through the strike plate 120. The housing 140 has a rear wall 141, opposite the open side, which extends generally parallel to the strike plate 120. Holes 142 and 143 are formed through the rear wall 141 to receive an additional, security screw (not shown) that is three inches long. Two holes are provided just in case a minor vertical adjustment of the keeper housing 140 is required after a hole has already been drilled into the jamb to align with one of the holes 142 and 143 (prior to the required adjustment).

The keeper housing 140 also includes a bottom wall 144 and pair of parallel sidewalls 145 and 146, each of which extends substantially perpendicularly away from a respective edge of the rear wall 141 (and substantially perpendicularly toward the strike plate 120). An opposite side or edge of each sidewall 145 and 146 is secured to the rear side of the strike plate 120 by welding or other means known in the art. Gaps are provided between the remaining sides or edges of the bottom wall 144 and the adjacent sides or edges of the sidewalls 145 and 146 to encourage passage of foreign material from within the housing 140.

Each sidewall 145 and 146 has an upper end 147 and 148, respectively, which is bent or folded over toward its counterpart and substantially perpendicular to the remainder of each sidewall 145 and 146. The upper ends 147 and 148 cooperate to provide a top wall for the housing 140 which is both strong in use and cost effective to manufacture. Each upper end 147 and 148 may be described as generally L-shaped, with a first portion of each cooperating to substantially cover the top of the housing 140, and with a second portion of each cooperating to provide a pair of opposing rails 155 and 156 for reasons discussed below. The rear wall 141 extends upward beyond the top wall defined by the ends 147 and 148. A hole 158 is formed through this extension of the rear wall 141 for reasons discussed below.

The keeper portion 100 further includes a latch keeper 160 which is described with reference to FIGS. 11–14. The latch keeper 160 includes a first flange 161, a second flange 162, and a third flange 163. The third flange 163 extends substantially perpendicular between and integrally interconnects the first flange 161 and the second flange 162. Notches 165 and 166 are formed in opposite sides of the second flange 162 proximate its juncture with the third flange 163. The notches 165 and 166 may be seen to divide the latch keeper 160 into a first or lower portion, which includes the third flange 163 and the first flange 161, and a second or upper portion, which includes the second flange 162.

The notches 165 and 166 are sized and configured to receive the rails 155 and 156 and thereby slidably mount the latch keeper 160 to the housing 140. In other words, the width of the second flange 162, as measured between the notches, is less than the width of the gap 159 defined between the rails 155 and 156; and the width of the second flange 162, as measured just above the notches, is greater than the width of the gap 159 defined between the rails 155 and 156. However, the width of the second flange 162, as measured at any point, is less than the width of the gap 151 defined between the sidewalls 145 and 146 of the housing 140, to allow the former to be inserted within the latter. When force is transmitted from the latch hook 450 to the latch keepers 160, the latter tends to rotate and dig into the top wall of the keeper housing 140.

Figure 5:
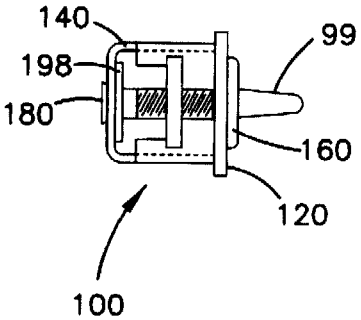
FIG. 5 is a top view of the preferred embodiment latch keeper assembly shown in FIG. 1.
Figure 4:
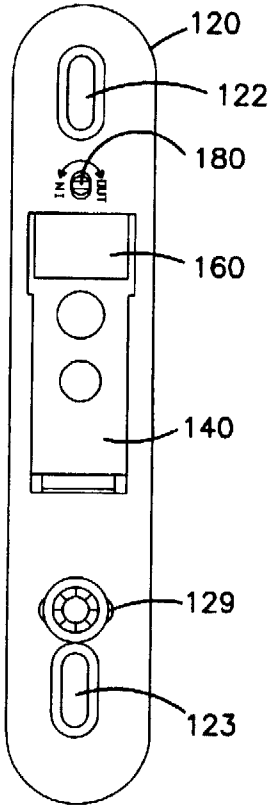
FIG. 4 is a front view of the preferred embodiment latch keeper assembly shown in FIG. 1.
Figure 3:
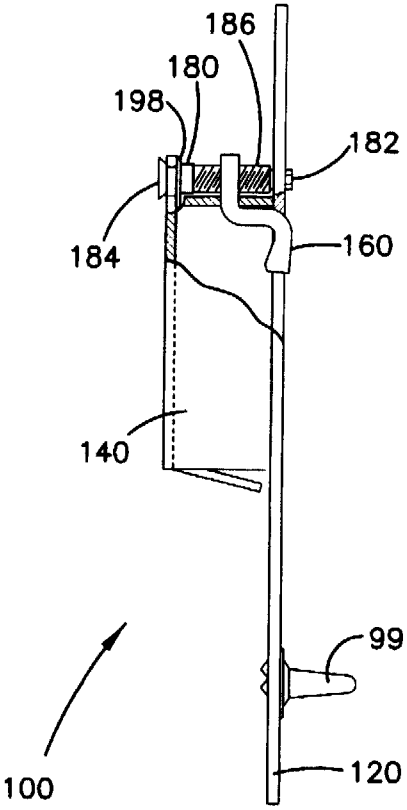
FIG. 3 is a partially sectioned side view of the preferred embodiment latch keeper assembly shown in FIG. 1.
Figure 10:
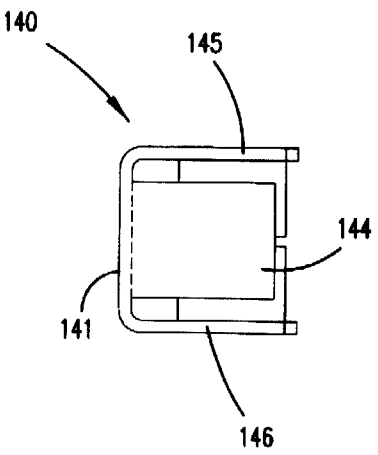
FIG. 10 is a bottom view of the keeper housing shown in FIG. 7.
Figure 9:
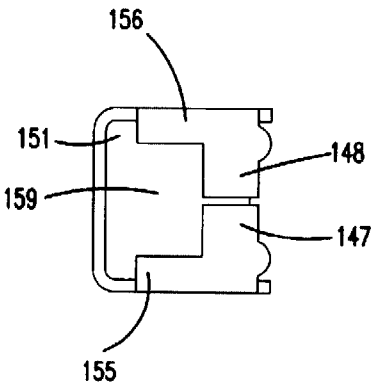
FIG. 9 is a top view of the keeper housing shown in FIG. 7.
Figure 8:
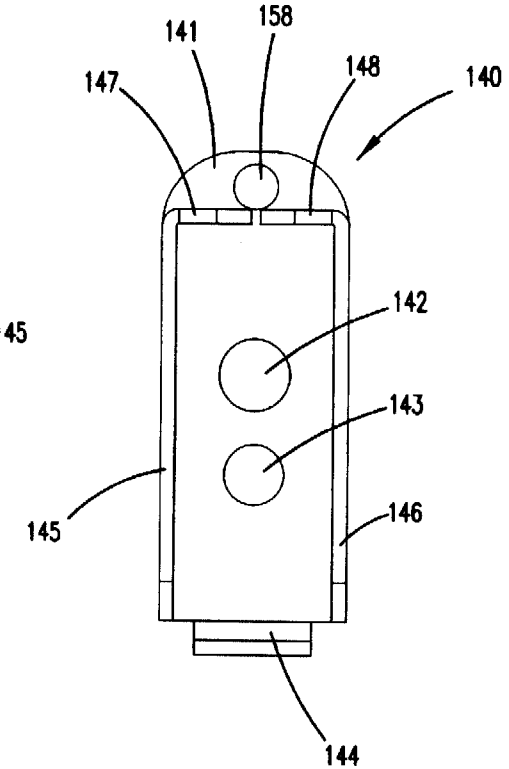
FIG. 8 is a front view of the keeper housing shown in FIG. 7.
Figure 7:
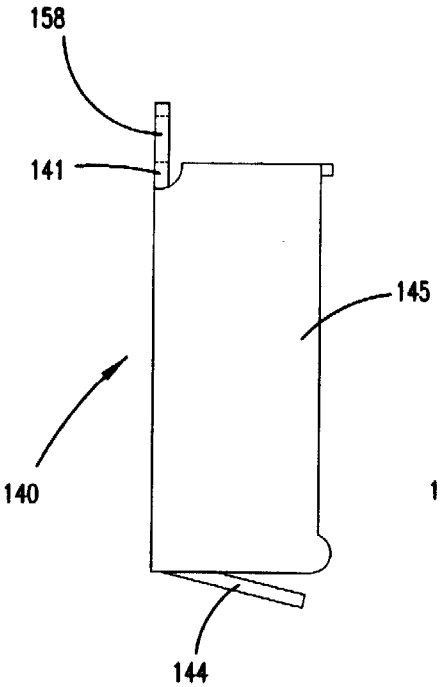
FIG. 7 is a side view of a keeper housing that is a part of the preferred embodiment latch keeper assembly shown in FIG. 1.

A threaded hole 168 is formed through the second flange 162 to align with the hole 158 and the opening 128 and receive a screw 180, when the notches 165 and 166 are engaged by the rails 155 and 156, as shown in FIGS. 3–5. The screw 180 includes a slotted end 182, an opposite end 184 having an enlarged head, and an intermediate, thread bearing shaft 186 extending therebetween. A clip 198 engages a circumferential groove about the shaft 186 proximate the head end 184 of the screw 180. The head end 184 and the clip 198 cooperate to prevent movement of the screw 180 relative to the housing 140 in a direction along the longitudinal axis of the screw 180.

The slotted end 182 of the screw 180 is accessible through the slot 128 in the strike plate 120 to facilitate rotation of same. Rotation of the screw 180 in a first direction causes the second flange 162 to travel along the screw 180 toward the strike plate 120, and rotation of the screw 180 in a second, opposite direction causes the second flange to travel along the screw 180 away from the strike plate 120. In this manner, the screw 180 facilitates adjustment of the extent or limit to which the latch keeper 160 extends beyond the strike plate 120 and thus, provides a means for adjusting the proximity of the face plate and the strike plate when the assembly 100 is latched; or in other words, provides a means for adjusting the extent to which weather stripping is compressed between the leading member and the vertical jamb.

When the second flange 162 is mounted on the rails 155 and 156 and engaged by the screw 180, the third flange 163 is disposed adjacent and parallel to the top wall of the housing 140, on a side opposite the second flange 162. The first flange 161 extends generally downward from the third flange 163 and spans a portion of the opening 124. The first flange 161 is sized and configured to be selectively engaged and disengaged by the latch hook 450. In particular, the first flange 161 extends at an acute angle away from the third flange 163, and the first flange 161 is provided with a concave bearing surface 169 to promote solid, complementary engagement and transfer of force in a direction perpendicular to the interface between the latch hook 450 and the latch keeper 160. The angle at which the latch hook 450 engages the latch keeper 160 is such that the tip of the former will engage the bearing surface on the latter, and any deformation will tend to increase the area of interface. The opening 124 in the strike plate 120, as well as the opening in the face plate, allows the latch hook 450 to access the latch keeper 160.

The relationship between the keeper 160 and the housing 140 is such that force applied on the keeper 160 causes the keeper 160 to rotate into engagement with the housing 140. The rear wall 141 of the housing 140 is designed to bend if force is transmitted through the screw 180, ensuring that the latch keeper 160 digs into the top wall of the housing 140 during an attempted forced opening of the door 96.

A method of making a latch assembly according to the principles of the present invention may be described with reference to the preferred embodiment discussed above. The housing 140 provides at least one wall 147 and 148 disposed about an opening 124 intended to receive at least a portion of a latch hook 450. The opening 124 may be formed through a strike plate 120 to which the housing 140 would then be attached. A rigid member 160 is formed to include a first portion 163 and 161 and a second portion 162 disposed on opposite sides of the wall 147 and 148. The member 160 is connected to the housing 140 in such a manner that the first portion 163 and 161 is disposed inside the wall 147 and 148, and the second portion 162 is disposed outside the wall 147 and 148. The first portion 163 and 161 is configured to be selectively engageable and disengageable by the latch hook 450.

The present invention has been described with reference to specific embodiments, methods, and applications. However, those skilled in the art will recognize additional embodiments, methods, and applications that fall within the scope of the present invention. Accordingly, the present invention is to be limited only to the extent of the appended claims.

What is claimed is:

1. A latch assembly, comprising:

a latch hook;

a strike plate, the strike plate having an opening formed therein to receive at least a portion of the latch hook;

a keeper housing connected to the strike plate and aligned relative to the opening, the keeper housing having a wall extending generally perpendicular to the strike plate; and a latch keeper, the latch keeper having:

a first flange sized and configured for selective engagement and disengagement by the latch hook;

a second flange slidably mounted relative to the wall; a third flange interconnected between the first flange and the second flange and extending generally perpendicular thereto, wherein the third flange is adjacent the wall and extends generally parallel thereto , and wherein said second flange and said third flange are disposed on opposite sides of said wall.

2. The latch assembly of claim 1, the keeper housing having a second wall extending generally parallel to the strike plate, the second flange disposed therebetween, and a screw extending through the second wall, the second flange, and the strike plate.

3. The latch assembly of claim 2, wherein rotation of the screw in a first direction causes the second flange to travel toward the second wall, and rotation of the screw in a second, opposite direction causes the second flange to travel toward the strike plate.

4. The latch assembly of claim 1, the first flange having a concave bearing surface which is selectively engaged by the latch hook.

5. The latch assembly of claim 4, wherein the first flange and the third flange define an acute angle therebetween.

6. The latch assembly of claim 1, wherein the keeper housing includes opposed sidewalls, and the wall is a top wall formed by bending upper portions of said opposed sidewalls toward one another.

7. A latch assembly, comprising:

a latch hook;

a keeper housing having a wall;

a latch keeper means, connected to the keeper housing, for selective engagement and disengagement by the latch hook, wherein the latch keeper means bears against opposite sides of the wall when engaged by the latch hook, further comprising an adjusting means, connected to the latch keeper means, for adjusting the latch keeper means relative to the keeper housing wherein the latch keeper means includes a first flange which is selectively engaged and disengaged by the latch hook, a second flange which overlies the wall, and a third flange which is interconnected between the first flange and the second flange and underlies the wall;

wherein notches are formed in opposite sides of the third flange to receive opposing portions of the wall.

8. The latch assembly of claim 7, wherein said first flange having a concave bearing surface which is selectively engaged by the latch hook.

9. The latch assembly of claim 7, wherein the first flange is configured to be selectively engaged by the latch hook having a complementary configuration.

10. A latch assembly, comprising:

a latch hook;

a strike plate, the strike plate having a first opening formed therein to receive at least a portion of the latch hook, and the strike plate having a second opening formed therein;

a keeper housing connected to the strike plate and aligned with the first opening, the keeper housing having at least one wall extending generally perpendicular to the strike plate:

a latch keeper, the latch keeper having a first flange disposed within the first opening, the first flange being sized and configured for selective engagement and disengagement by the latch hook, and the latch keeper having a second flange with a hole formed therein wherein said first flange and said second flange are disposed on opposite sides of said wall; and a screw extending through the hole in the second flange of the latch keeper and accessible through the second opening in the strike plate, wherein rotation of the screw in a first direction causes movement of the second flange toward the strike plate, and rotation of the screw in a second, opposite direction causes movement of the second flange away from the strike plate.

11. The latch assembly of claim 10, wherein the second opening is elongate to accommodate travel of the screw in a direction perpendicular to an axis about which the screw rotates.

12. The latch assembly of claim 10, the screw extending through the second opening.

13. The latch assembly of claim 10, wherein at least one additional opening is formed in the strike plate to facilitate mounting of the strike plate to a side jamb.

14. The latch assembly of claim 10, the latch keeper further including a third flange interconnected between the first flange and the second flange.

15. The latch assembly of claim 14, the third flange and the first flange defining an acute angle therebetween.

16. The latch assembly of claim 14, wherein the at least one wall of the keeper housing is adjacent the third flange and extends generally parallel thereto.

17. The latch assembly of claim 10, the first flange having a concave bearing surface which is selectively engaged by the latch hook.

18. The latch assembly of claim 10, wherein the keeper housing has opposing rails, wherein notches are formed in opposite sides of the second flange on the latch keeper to receive the rails.

19. The latch assembly of claim 18, the latch keeper further including a third flange interconnected between the first flange and the second flange, the at least one wall of the keeper housing being adjacent the third flange and extending generally parallel thereto, the rails and the at least one wall being substantially co-planar.

20. The latch assembly of claim 10, the keeper housing having an additional wall extending generally parallel to the strike plate, the additional wall having a hole formed therein to received the screw.

21. The latch assembly of claim 20, wherein the second flange is disposed between the additional wall and the strike plate, and the screw extends from a head, through the additional wall, through the second flange, and through the strike plate, and a clip is secured to the screw adjacent the additional wall and opposite the head.

22. The latch assembly of claim 21, wherein an end of the screw opposite the head is slotted.

* * * * *